US009646615B2

(12) United States Patent
Kishore

(10) Patent No.: US 9,646,615 B2
(45) **Date of Patent: *May 9, 2017**

(54) AUDIO SIGNAL ENCODING EMPLOYING INTERCHANNEL AND TEMPORAL REDUNDANCY REDUCTION

(71) Applicant: SLING MEDIA PVT LTD, Bangalore (IN)

(72) Inventor: Nandury V. Kishore, Bangalore (IN)

(73) Assignee: EchoStar Technologies L.L.C., Englewood, CO (US)

( * ) Notice: Subject to any disclaimer, the term of this patent is extended or adjusted under 35 U.S.C. 154(b) by 817 days.

This patent is subject to a terminal disclaimer.

(21) Appl. No.: 13/953,177

(22) Filed: Jul. 29, 2013

(65) Prior Publication Data

US 2013/0318010 A1 Nov. 28, 2013

Related U.S. Application Data

(63) Continuation of application No. 12/558,048, filed on Sep. 11, 2009, now Pat. No. 8,498,874.

(51) Int. Cl.

| | |
|---|---|
| ***G10L 19/00*** | (2013.01) |
| ***G10L 19/02*** | (2013.01) |
| ***G10L 19/032*** | (2013.01) |

(52) U.S. Cl.

CPC ..... *G10L 19/00* (2013.01); *G10L 19/0212* (2013.01); *G10L 19/032* (2013.01)

(58) Field of Classification Search

CPC ..... G10L 19/00; G10L 19/02; G10L 19/0204; G10L 19/0208; G10L 19/022;

(Continued)

(56) References Cited

U.S. PATENT DOCUMENTS 5,388,181 A 2/1995 Anderson et al.
5,752,224 A * 5/1998 Tsutsui ..... G10L 19/035 381/102

(Continued)

FOREIGN PATENT DOCUMENTS

WO 02084645 A2 10/2002
WO 2009029035 A1 3/2009

OTHER PUBLICATIONS

Intellectual Property Office, Office Action, issued Jul. 30, 2013 for Taiwan Patent Application No. 099130751.

(Continued)

*Primary Examiner* — Qi Han
(74) *Attorney, Agent, or Firm* — LK Global

(57) ABSTRACT

A method of encoding a time-domain audio signal is presented. A device transforms the time-domain signal into a frequency-domain signal including a sequence of sample blocks, wherein each block includes a coefficient for each of multiple frequencies. The coefficients of each block are grouped into frequency bands. For each frequency band of each block, a scale factor is estimated for the band, and the energy of the band for the block is compared with the energy of the band of an adjacent sample block, wherein the blocks may be adjacent to each other in either or both of an interchannel and a temporal sense. If the ratio of the band energy for the first block to the band energy for the adjacent block is less than some value, the scale factor of the band for the first block is increased. The coefficients of the band for each block are quantized based on the resulting scale factor. The encoded audio signal is generated based on the quantized coefficients and the scale factors.

9 Claims, 7 Drawing Sheets

(58) Field of Classification Search
CPC ..... G10L 19/032; G10L 19/035; G10L 19/04; G10L 19/06; G10L 19/167
USPC ..... 704/503, 500, 501, 502
See application file for complete search history.

(56) References Cited

U.S. PATENT DOCUMENTS

| | | | | |
|---|---|---|---|---|
| 5,765,126 | A * | 6/1998 | Tsutsui | G10L 19/002 704/200.1 |
| 5,805,770 | A | 9/1998 | Tsutsui | |
| 8,019,614 | B2 | 9/2011 | Takagi et al. | |
| 2005/0010397 | A1* | 1/2005 | Sakurai | G10L 21/04 704/205 |
| 2009/0018824 | A1 | 1/2009 | Teo | |
| 2011/0029310 | A1 | 2/2011 | Jung et al. | |
| 2011/0066440 | A1 | 3/2011 | Kishore | |

OTHER PUBLICATIONS

European Patent Office, International Search Report and Written Opinion, dated Mar. 16, 2011, for International Appln. No. PCT/IN2010/000595.

Church, Steve, "On Beer and Audio Coding, Why something called AAC is cooler than a fine pilsner, and how it got to be that way", Radio World, dated Sep. 26, 2001, 12 pages.

Brandenburg, Karlheinz, "MP3 and AAC Explained", AES 17th International Conference on High Quality Audio Coding, 12 pages.

"Advanced Audio Coding", retrieved from Wikipedia internet site located at http://en.wikipedia.org/w/index.php?title=Advance_Audio_Coding&printable=yes on Jul. 28, 2009, 11 pages.

Wikipedia "ACC", retrieved from internet site located at http://everything2.com/title/AAC?displaytype=printable on Jul. 28, 2009, 4 pages.

"Modified Discrete Cosine Transform", retrieved from Wikipedia internet site located at http://en.wikipedia.org/w/index.php?title=Modified_discrete_cosine_transform&printable . . . on Jul. 28, 2009, 6 pages.

"How Audio Codecs Work—Psycoacoustics", retrieved from Audio DesignLine internet site located at http://www.audiodesignline.com/howto/audioprocessing/175800470 on Jul. 28, 2009, 3 pages.

USPTO, Non-Final Office Action, dated Oct. 4,2012 for U.S. Appl. No. 12/558,048.

USPTO, Notice of Allowance, dated Apr. 1, 2013 for U.S. Appl. No. 12/558,048.

* cited by examiner

AUDIO SIGNAL ENCODING EMPLOYING INTERCHANNEL AND TEMPORAL REDUNDANCY REDUCTION

BACKGROUND

Efficient compression of audio information reduces both the memory capacity requirements for storing the audio information, and the communication bandwidth needed for transmission of the information. To enable this compression, various audio encoding schemes, such as the ubiquitous Motion Picture Experts Group 1 (MPEG-1) Audio Layer 3 (MP3) format and the newer Advanced Audio Coding (AAC) standard, employ at least one psychoacoustic model (PAM), which essentially describes the limitations of the human ear in receiving and processing audio information. For example, the human audio system exhibits an acoustic masking principle in both the frequency domain (in which audio at a particular frequency masks audio at nearby frequencies below certain volume levels) and the time domain (in which an audio tone of a particular frequency masks that same tone for some time period after removal). Audio encoding schemes providing compression take advantage of these acoustic masking principles by removing those portions of the original audio information that would be masked by the human audio system.

To determine which portions of the original audio signal to remove, the audio encoding system typically processes the original signal to generate a masking threshold, so that audio signals lying beneath that threshold may be eliminated without a noticeable loss of audio fidelity. Such processing is quite computationally-intensive, making real-time encoding of audio signals difficult. Further, performing such computations is typically laborious and time-consuming for consumer electronics devices, many of which employ fixed-point digital signal processors (DSPs) not specifically designed for such intense processing.

BRIEF DESCRIPTION OF THE DRAWINGS

Many aspects of the present disclosure may be better understood with reference to the following drawings. The components in the drawings are not necessarily depicted to scale, as emphasis is instead placed upon clear illustration of the principles of the disclosure. Moreover, in the drawings, like reference numerals designate corresponding parts throughout the several views. Also, while several embodiments are described in connection with these drawings, the disclosure is not limited to the embodiments disclosed herein. On the contrary, the intent is to cover all alternatives, modifications, and equivalents.

DETAILED DESCRIPTION

The enclosed drawings and the following description depict specific embodiments of the invention to teach those skilled in the art how to make and use the best mode of the invention. For the purpose of teaching inventive principles, some conventional aspects have been simplified or omitted. Those skilled in the art will appreciate variations of these embodiments that fall within the scope of the invention. Those skilled in the art will also appreciate that the features described below can be combined in various ways to form multiple embodiments of the invention. As a result, the invention is not limited to the specific embodiments described below, but only by the claims and their equivalents.

Figure 1:
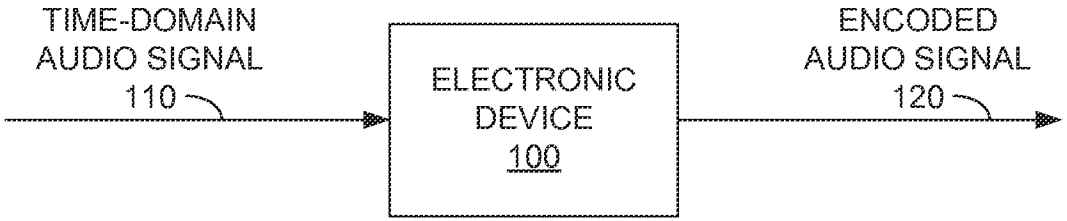
FIG. 1 is a simplified block diagram of an electronic device configured to encode a time-domain audio signal according to an embodiment of the invention.

FIG. 1 provides a simplified block diagram of an electronic device 100 configured to encode a time-domain audio signal 110 as an encoded audio signal 120 according to an embodiment of the invention. In one implementation, the encoding is performed according to the Advanced Audio Coding (AAC) standards, although other encoding schemes involving the transformation of a time-domain signal into an encoded audio signal may utilize the concepts discussed below to advantage. Further, the electronic device 100 may be any device capable of performing such encoding, including, but not limited to, personal desktop and laptop computers, audio/video encoding systems, compact disc (CD) and digital video disk (DVD) players, television set-top boxes, audio receivers, cellular phones, personal digital assistants (PDAs), and audio/video place-shifting devices, such as the various models of the Slingbox® provided by Sling Media, Inc.

Figure 2:
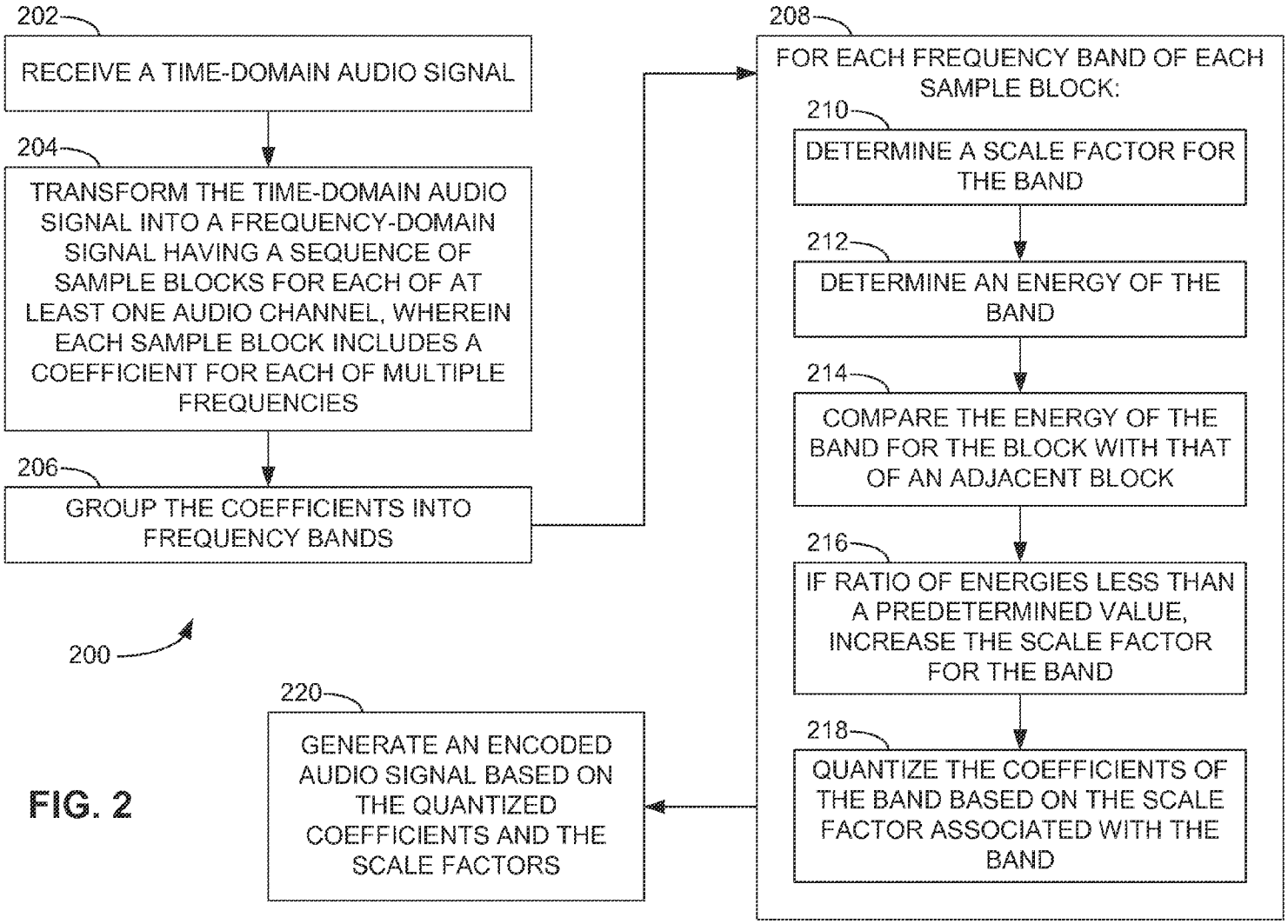
FIG. 2 is a flow diagram of a method of operating the electronic device of FIG. 1 to encode a time-domain audio signal according to an embodiment of the invention.

FIG. 2 presents a flow diagram of a method 200 of operating the electronic device 100 of FIG. 1 to encode the time-domain audio signal 110 to yield the encoded audio signal 120. In the method 200, the electronic device 100 receives the time-domain audio signal 110 (operation 202). The device 100 then transforms the time-domain audio signal 110 into a frequency-domain signal having a sequence of sample blocks for each of at least one audio channel (operation 204). Each sample block comprises a coefficient for each of multiple frequencies. The coefficients of each sample block are grouped or organized into frequency bands (operation 206). For each frequency band of each sample block (operation 208), the electronic device 100 determines or estimates a scale factor for the band (operation 210), determines an energy of the frequency band (operation 212), and compares the energy of the band for the sample block with the band energy of an adjacent sample block (operation 214). Examples of an adjacent sample block may include the immediately-preceding block of the same audio channel, or the sample block of another audio channel that is identified with the same time period as the original sample block. If the ratio of the frequency band energy for the sample block to the frequency band energy for the adjacent sample block is less than a predetermined value, the device 100 increases the scale factor of the frequency band of the sample block (operation 216). For each frequency band of each block, the device 100 quantizes the coefficients of the frequency band based on the scale factor associated with that band (operation 218).

The device 100 generates the encoded audio signal 120 based on the quantized coefficients and the scale factors (operation 220).

While the operations of FIG. 2 are depicted as being executed in a particular order, other orders of execution, including concurrent execution of two or more operations, may be possible. For example, the operations of FIG. 2 may be executed as a type of execution "pipeline", wherein each operation is performed on a different portion or sample block of the time-domain audio signal 110 as it enters the pipeline. In another embodiment, a computer-readable storage medium may have encoded thereon instructions for at least one processor or other control circuitry of the electronic device 100 of FIG. 1 to implement the method 200.

As a result of at least some embodiments of the method 200, the scale factor utilized for each frequency band to quantize the coefficients of that band are adjusted based on differences in audio energy in a frequency band between consecutive frequency sample blocks in the same audio channel, and between simultaneous blocks of different channels. Such determinations are typically much less computationally-intensive than a calculation of a complete masking threshold, as is typically performed in most AAC implementations. As a result, real-time audio encoding by any class of electronic device, including small devices utilizing inexpensive digital signal processing components, may be possible. Other advantages may be recognized from the various implementations of the invention discussed in greater detail below.

Figure 3:
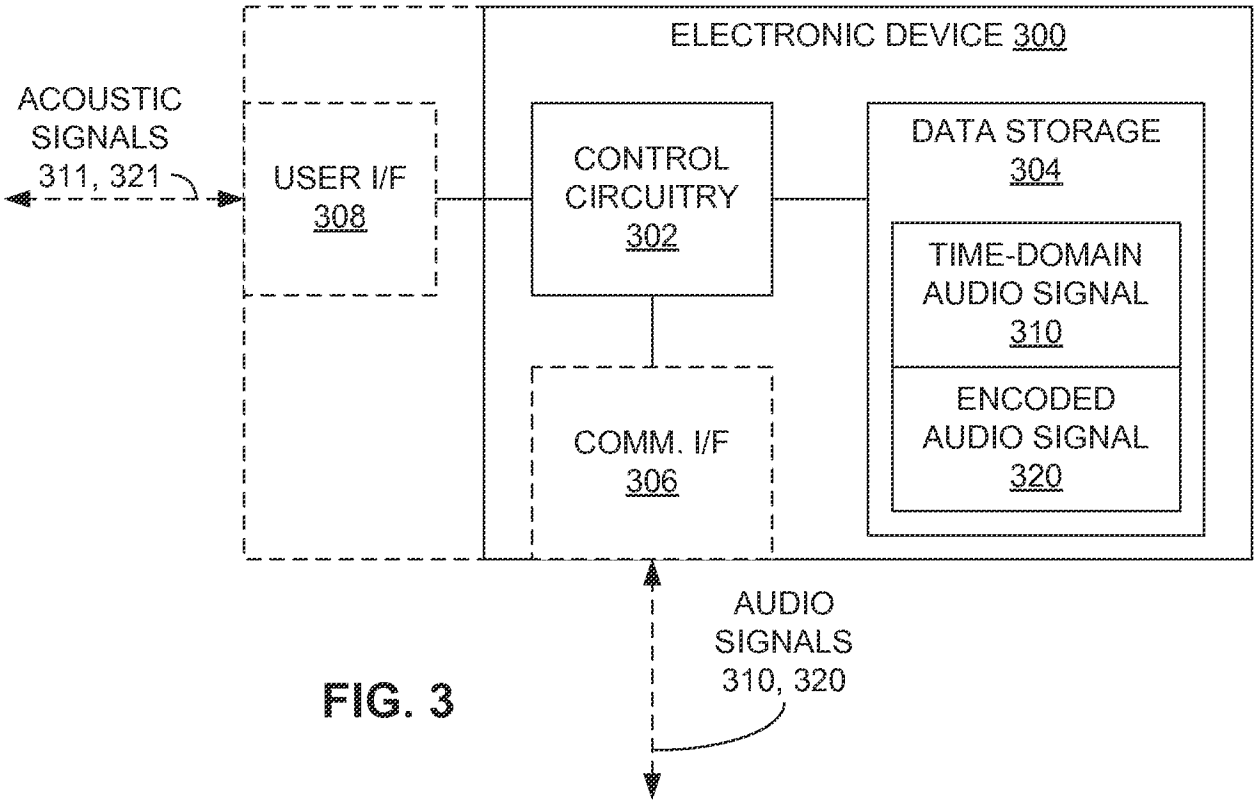
FIG. 3 is a block diagram of an electronic device according to another embodiment of the invention.

FIG. 3 is a block diagram of an electronic device 300 according to another embodiment of the invention. The device 300 includes control circuitry 302 and data storage 304. In some implementations, the device 300 may also include either or both of a communication interface 306 and a user interface 308. Other components, including, but not limited to, a power supply and a device enclosure, may also be included in the electronic device 300, but such components are not explicitly shown in FIG. 3 nor discussed below to simplify the following discussion.

The control circuitry 302 is configured to control various aspects of the electronic device 300 to encode a time-domain audio signal 310 as an encoded audio signal 320. In one embodiment, the control circuitry 302 includes at least one processor, such as a microprocessor, microcontroller, or digital signal processor (DSP), configured to execute instructions directing the processor to perform the various operations discussed in greater detail below. In another example, the control circuitry 302 may include one or more hardware components configured to perform one or more of the tasks or operations described hereinafter, or incorporate some combination of hardware and software processing elements.

The data storage 304 is configured to store some or all of the time-domain audio signal 310 to be encoded and the resulting encoded audio signal 320. The data storage 304 may also store intermediate data, control information, and the like involved in the encoding process. The data storage 304 may also include instructions to be executed by a processor of the control circuitry 302, as well as any program data or control information concerning the execution of the instructions. The data storage 304 may include any volatile memory components (such as dynamic random-access memory (DRAM) and static random-access memory (SRAM)), nonvolatile memory devices (such as flash memory, magnetic disk drives, and optical disk drives, both removable and captive), and combinations thereof The electronic device 300 may also include a communication interface 306 configured to receive the time-domain audio signal 310, and/or transmit the encoded audio signal 320 over a communication link. Examples of the communication interface 306 may be a wide-area network (WAN) interface, such as a digital subscriber line (DSL) or cable interface to the Internet, a local-area network (LAN), such as Wi-Fi or Ethernet, or any other communication interface adapted to communicate over a communication link or connection in a wired, wireless, or optical fashion.

In other examples, the communication interface 306 may be configured to send the audio signals 310, 320 as part of audio/video programming to an output device (not shown in FIG. 3), such as a television, video monitor, or audio/video receiver. For example, the video portion of the audio/video programming may be delivered by way of a modulated video cable connection, a composite or component video RCA-style (Radio Corporation of America) connection, and a Digital Video Interface (DVI) or High-Definition Multimedia Interface (HDMI) connection. The audio portion of the programming may be transported over a monaural or stereo audio RCA-style connection, a TOSLINK connection, or over an HDMI connection. Other audio/video formats and related connections may be employed in other embodiments.

Further, the electronic device 300 may include a user interface 308 configured to receive acoustic signals 311 represented by the time-domain audio signal 310 from one or more users, such as by way of an audio microphone and related circuitry, including an amplifier, an analog-to-digital converter (ADC), and the like. Likewise, the user interface 308 may include amplifier circuitry and one or more audio speakers to present to the user acoustic signals 321 represented by the encoded audio signal 320. Depending on the implementation, the user interface 308 may also include means for allowing a user to control the electronic device 300, such as by way of a keyboard, keypad, touchpad, mouse, joystick, or other user input device. Similarly, the user interface 308 may provide a visual output means, such as a monitor or other visual display device, allowing the user to receive visual information from the electronic device 300.

Figure 4:
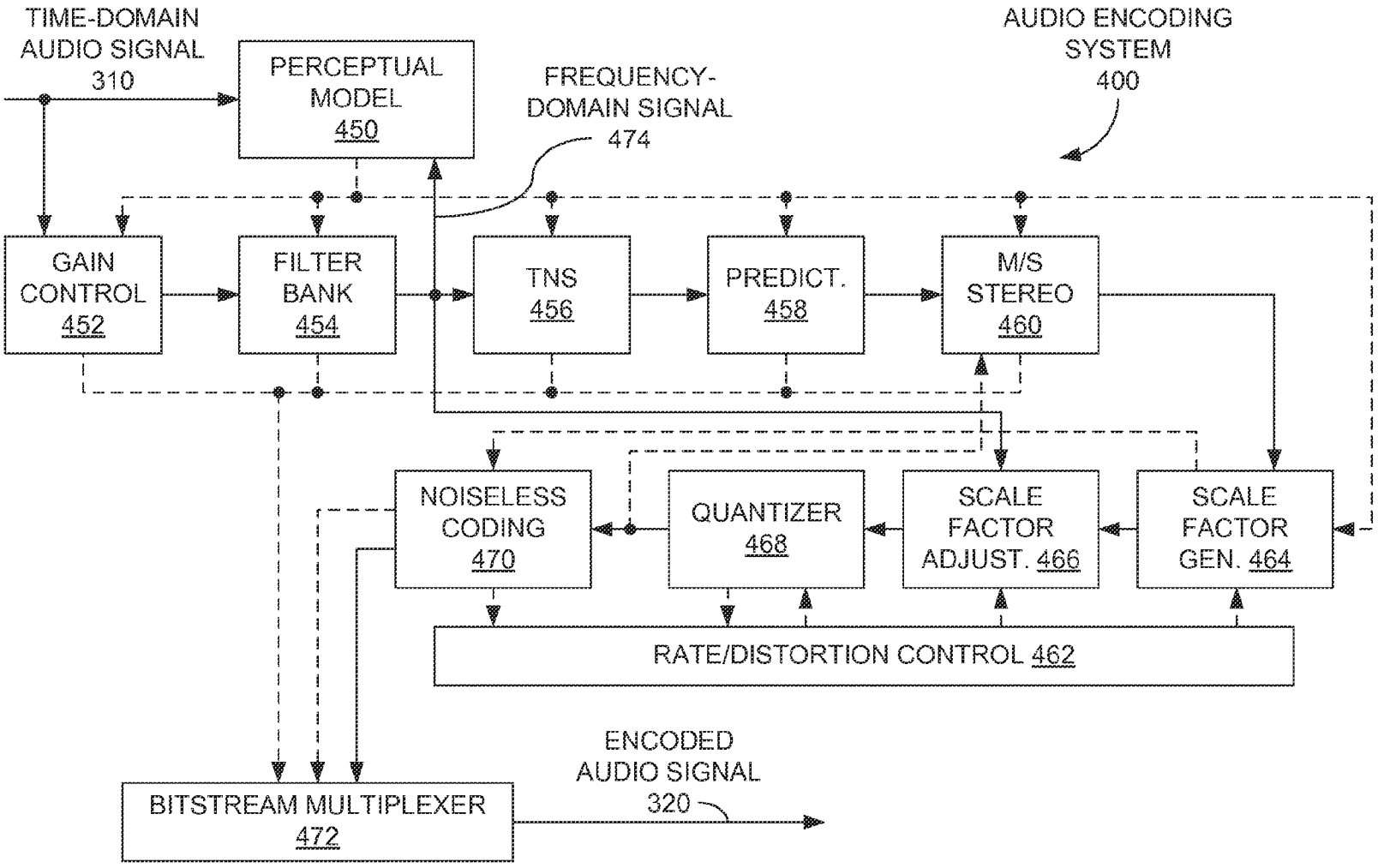
FIG. 4 is a block diagram of an audio encoding system according to an embodiment of the invention.

FIG. 4 provides an example of an audio encoding system 400 provided by the electronic device 300 to encode the time-domain audio signal 310 as the encoded audio signal 320 of FIG. 3. The control circuitry 302 of FIG. 3 may implement each portion of the audio encoding system 400 by way of hardware circuitry, a processor executing software or firmware instructions, or some combination thereof The specific system 400 of FIG. 4 represents a particular implementation of AAC, although other audio encoding schemes may be utilized in other embodiments. Generally, AAC represents a modular approach to audio encoding, whereby each functional block 450-472 of FIG. 4, as well as those not specifically depicted therein, may be implemented in a separate hardware, software, or firmware module or "tool", thus allowing modules originating from varying development sources to be integrated into a single encoding system 400 to perform the desired audio encoding. As a result, the use of different numbers and types of modules may result in the formation of any number of encoder "profiles", each capable of addressing specific constraints associated with a particular encoding environment. Such constraints may include the computational capability of the device 300, the complexity of the time-domain audio signal 310, and the desired characteristics of the encoded audio signal 320, such as the output bit rate and distortion level. The AAC standard typically offers four default profiles, including the low-complexity (LC) profile, the main (MAIN) profile, the sample-rate scalable (SRS) profile, and the long-term prediction (LTP) profile. The system 400 of FIG. 4 corresponds primarily with the main profile without an intensity/coupling module, although other profiles may incorporate the enhancements discussed below, including a temporal/interchannel scale factor adjustment function block 466 described in greater detail hereinafter.

FIG. 4 depicts the general flow of the audio data by way of solid arrowed lines, while some of the possible control paths are illustrated via dashed arrowed lines. Other possibilities regarding the passing of control information among the modules 450-472 not specifically shown in FIG. 4 may be possible in other arrangements.

In FIG. 4, the time-domain audio signal 310 is received as an input to the system 400. Generally, the time-domain audio signal 310 includes one or more channels of audio information formatted as a series of digital sample blocks of a time-varying audio signal. In some embodiments, the time-domain audio signal 310 may originally take the form of an analog audio signal that is subsequently digitized at a prescribed rate, such as by way of an ADC of the user interface 308, before being forwarded to the encoding system 400, as implemented by the control circuitry 302.

As illustrated in FIG. 4, the modules of the audio encoding system 400 may include a gain control block 452, a filter bank 454, a temporal noise shaping (TNS) block 456, a backward prediction tool 458, and a mid/side stereo block 460, configured as part of a processing pipeline that receives the time-domain audio signal 310 as input. These function blocks 452-460 may correspond to the same functional blocks often seen in other implementations of AAC. The time-domain audio signal 310 is also forwarded to a perceptual model 450, which may provide control information to any of the function blocks 452-460 mentioned above. In a typical AAC system, this control information indicates which portions of the time-domain audio signal 310 are superfluous under a psychoacoustic model (PAM), thus allowing those portions of the audio information in the time-domain audio signal 310 to be discarded to facilitate compression as realized in the encoded audio signal 320.

To this end, in typical AAC systems, the perceptual model 450 calculates a masking threshold from an output of a Fast Fourier Transform (FFT) of the time-domain audio signal 310 to indicate which portions of the audio signal 310 may be discarded. In the example of FIG. 4, however, the perceptual model 450 receives the output of the filter bank 454, which provides a frequency-domain signal 474. In one particular example, the filter bank 454 is a modified discrete cosine transform (MDCT) function block, as is normally provided in AAC systems.

Figure 5:
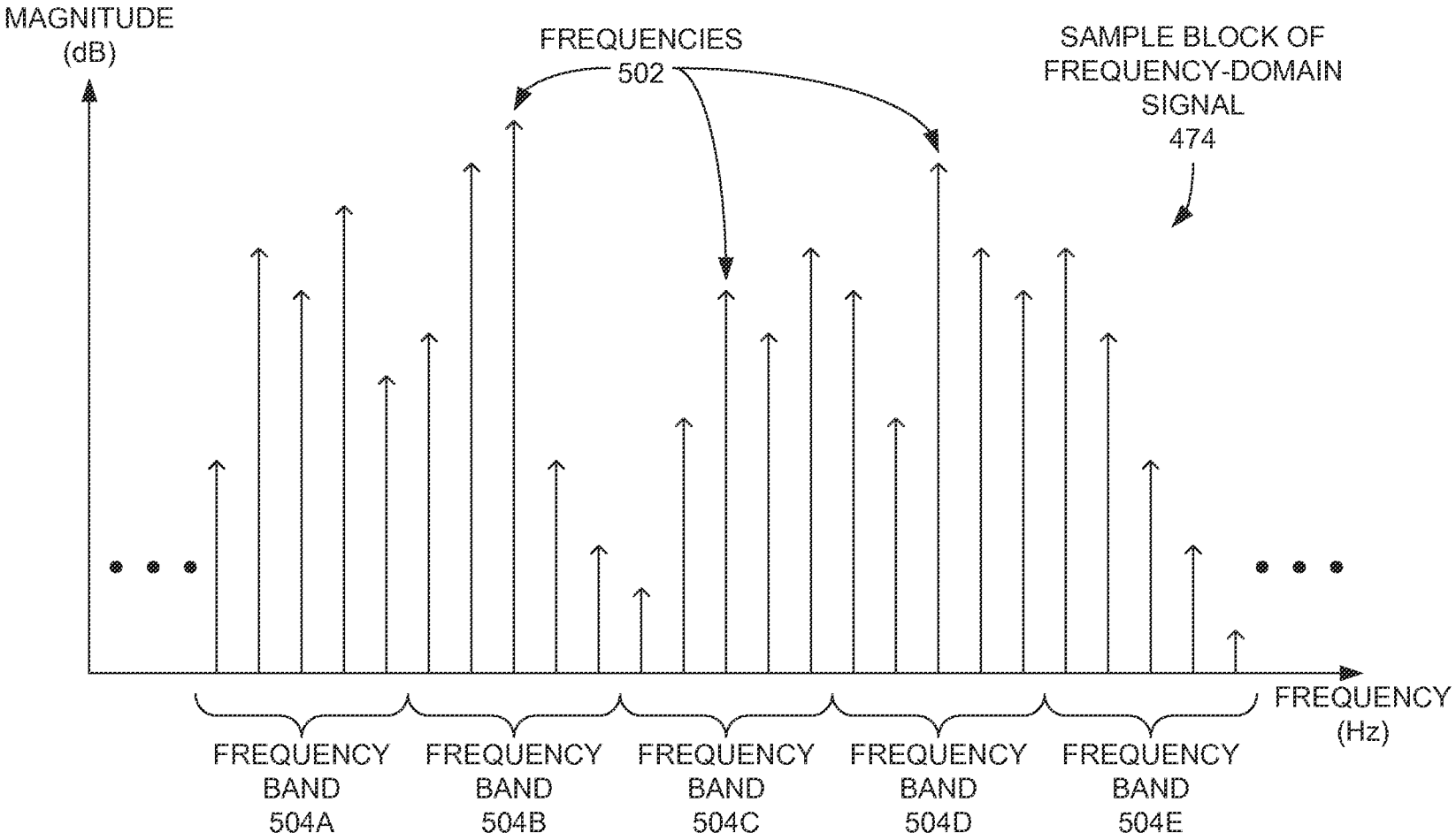
FIG. 5 is a graphical depiction of a sample block of a frequency-domain signal possessing frequency bands according to an embodiment of the invention.

The frequency-domain signal 474 produced by the MDCT function 454 includes a series of sample blocks, such as the block represented graphically in FIG. 5, with each block including a number of frequencies 502 for each channel of audio information to be encoded. Further, each frequency 502 is represented by a coefficient indicating the magnitude or intensity of that frequency 502 in the frequency-domain signal 474 block. In FIG. 5, each frequency 502 is depicted as a vertical vector whose height represents the value of the coefficient associated with that frequency 502.

Additionally, the frequencies 502 are logically organized into contiguous frequency groups or "bands" 504A-504E, as is done in typical AAC schemes. While FIG. 4 indicates that each frequency band 504 (i.e., each of the frequency bands 504A-504E) utilizes the same range of frequencies, and includes the same number of discrete frequencies 502 produced by the filter bank 454, varying numbers of frequencies 502 and sizes of frequency 502 ranges may be employed among the bands 504, as is often the case is AAC systems.

The frequency bands 504 are formed to allow the coefficient of each frequency 502 of a band 504 of frequencies 502 to be scaled or divided by way of a scale factor generated by the scale factor generator 464 of FIG. 4. Such scaling reduces the amount of data representing the frequency 502 coefficients in the encoded audio signal 320, thus compressing the data, resulting in a lower transmission bit rate for the encoded audio signal 320. This scaling also results in quantization of the audio information, wherein the frequency 502 coefficients are forced into discrete predetermined values, thus possibly introducing some distortion in the encoded audio signal 320 after decoding. Generally speaking, higher scaling factors cause coarser quantization, resulting in higher audio distortion levels and lower encoded audio signal 320 bit rates.

To meet predetermined distortion levels and bit rates for the encoded audio signal 320 in previous AAC systems, the perceptual model 450 calculates the masking threshold mentioned above to allow the scale factor generator 464 to determine an acceptable scale factor for each sample block of the encoded audio signal 320. Such generation of a masking threshold may also be employed herein to allow the scale factor generator 464 to determine an initial scale factor for each frequency band of each sample block of the frequency-domain signal 474. However, in other implementations, the perceptual model 450 instead determines the energy associated with the frequencies 502 of each frequency band 504, and which may then be used by the scale factor generator 464 to calculate a desired scale factor for each band 504 based on that energy. In one example, the energy of the frequencies 502 in a frequency band 504 is calculated by the "absolute sum", or the sum of the absolute value, of the MDCT coefficients of the frequencies 502 in the band 504, sometimes referred to as the sum of absolute spectral coefficients (SASC).

Once the energy for the band 504 is determined, the scale factor associated with the band 504 for each sample block may be calculated by taking a logarithm, such as a base-ten logarithm, of the energy of the band 504, adding a constant value, and then multiplying that term by a predetermined multiplier to yield at least an initial scale factor for the band 504. Experimentation in audio encoding according to previously known psychoacoustic models indicates that a constant of approximately 1.75 and a multiplier of 10 yield scale factors comparable to those generated as a result of extensive masking threshold calculations. Thus, for this particular example, the following equation for a scale factor is produced.

$$\text{scale_factor}=(\log_{10}(\Sigma|\text{band_coefficients}|)+1.75)*10$$

Other values for the constant other than 1.75 may be employed in other configurations.

To encode the time-domain audio signal 310, the MDCT filter bank 454 produces a series of blocks of frequency samples for the frequency-domain signal 474, with each block being associated with a particular time period of the time-domain audio signal 310. Thus, the scale factor calculations noted above may be undertaken for every block of each channel of frequency samples produced in the frequency-domain signal 474, thus potentially providing a different scale factor for each block of each frequency band 504. Given the amount of data involved, the use of the above calculation for each scale factor significantly reduces the amount of processing required to determine the scale factors compared to estimating a masking threshold for the same blocks of frequency samples. Other methods by which the initial scale factors may be estimated in the scale factor generator 464, with or without the calculation of a masking threshold, may be utilized in other implementations.

Figure 6:
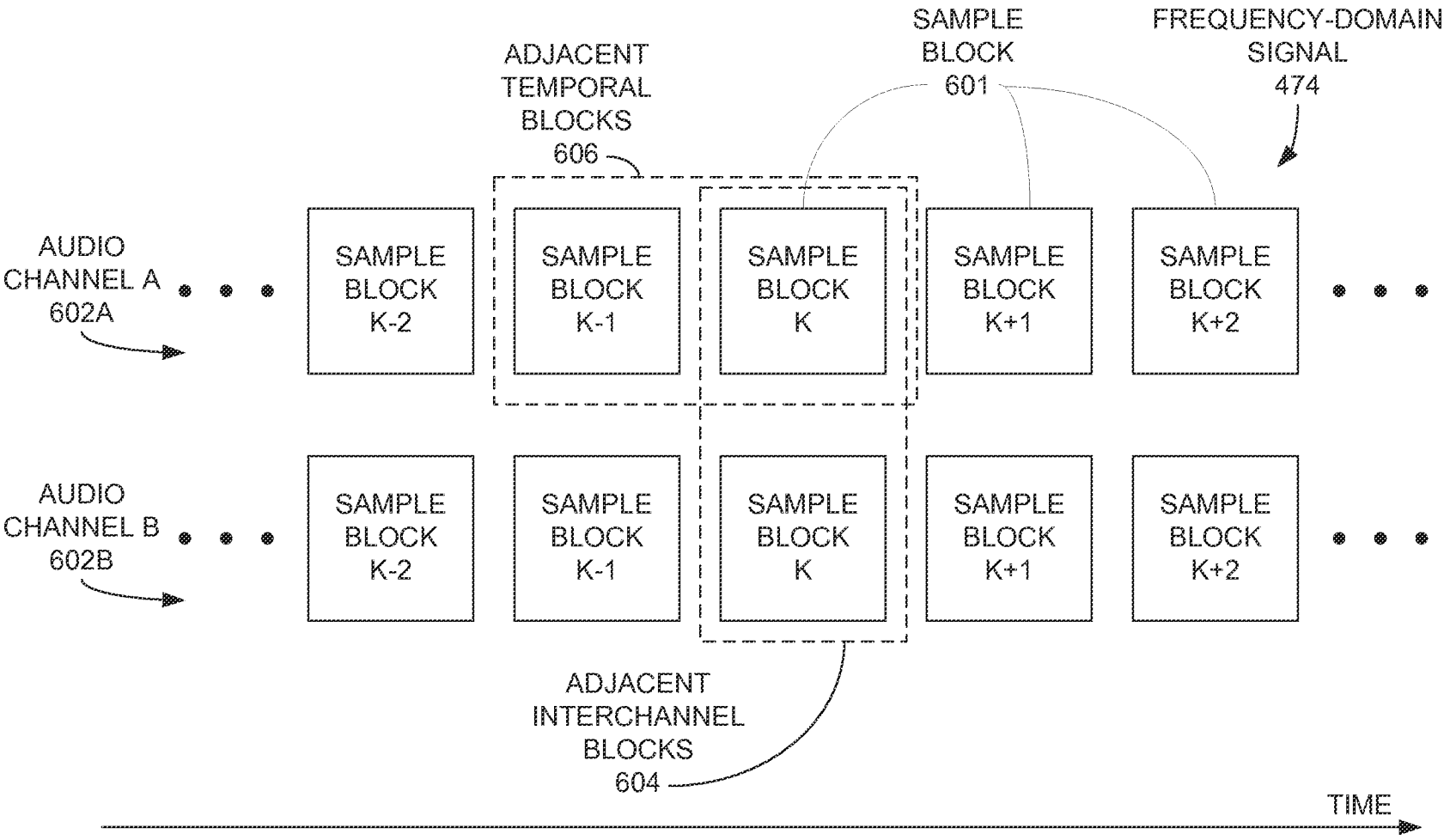
FIG. 6 is a graphical representation of sample blocks of two audio channels of a frequency-domain signal according to an embodiment of the invention.

An example of a frequency-domain signal 474 including two separate audio channels A and B (602A and 602B) is illustrated graphically in FIG. 6. The audio of each audio channel 602 is represented as a sequence of blocks 601 of frequency samples, with each block 601 associated with a particular time period of the original time-domain audio signal 310. In some embodiments, the time periods associated with two consecutive sample blocks of the same audio channel may overlap. For example, by using employing the MDCT for the filter bank 454, the time period associated with each block overlaps the time period of the next block by 50%.

In implementations discussed herein, a previously generated or estimated scale factor for each frequency band 504 of each sample block 601 provided by the scale factor generator 464 may be further increased in view of temporal and/or interchannel redundancies present in "adjacent" ones of the sample blocks 601. As shown in FIG. 6, two blocks 606 of the same channel 602 may be adjacent in a temporal sense if one immediately follows the other in sequence. Interchannel blocks may be adjacent if they are associated with the same time period, as shown by the example of adjacent interchannel blocks 604 shown in FIG. 6.

In either case, some audio information in one block of a pair of adjacent ones of the sample blocks 601 may be discarded if the energy in the adjacent block is sufficiently high compared to that of the first block. Using the adjacent temporal blocks 606 of FIG. 6 as an example, if the energy of a frequency band 504 of the k-lst block of the pair 606 is greater than that of the same band 504 of the kth block by some amount or percentage, the previously determined scale factor from the scale factor generator 464 for the frequency band 504 may be increased, thus reducing the number of quantization levels for the frequency band 504 of that block 601, and thus reducing the amount of data needed to represent the block 601 in the encoded audio signal 320. Increasing the scale factor in this manner results in little or no added noticeable distortion in the encoded audio signal 320 since the associated audio is masked to some degree by the higher energy associated with the frequency band 504 of the preceding block 601.

Similarly, if the energy of a frequency band 504 of one of the two adjacent interchannel blocks 604 is sufficiently higher than that of the corresponding band 504 of the other block, than the scale factor for the band 504 of the other block may be increased some percentage or amount without significant loss of audio fidelity. In both the temporal and interchannel cases, each frequency band 504 of each sample block 601 of each channel 602 of the frequency-domain signal 474 may be checked in such a manner to determine whether an increase in scale factor is possible.

The control circuitry 466 of FIG. 4 provides such functionality in the system 400 of FIG. 4 in the scale factor adjustment function block 466. In one implementation, the energy of each frequency band 504 of each sample block 601 may be calculated by way of summing the absolute value of all frequency coefficients of the frequency band 504, or calculating the SASC for the band 504, as described above. Other measures of energy may be employed in other examples.

In one arrangement, the energy values of the two adjacent sample blocks 601 are compared by way of a ratio. For example, to address temporal redundancy in the adjacent temporal blocks 606, the control circuitry 302 of the device 300 may compute the ratio of the energy of a band 504 of the latter block 601 of the adjacent temporal block 606 (e.g., the kth block of an audio channel 602) to the energy of the band 504 of the immediately-preceding block 601 (e.g., the k-lth block of the audio channel 602). This ratio may then be compared to a predetermined value or percentage, such as 0.5 or 50%. If the ratio is less than the predetermined value, the scale factor associated with the band 504 of the latter block 601 may be increased. The increase may be incremental (such as by one), by some predetermined amount (such as by one, two, or three), by a percentage (such as 10%), or by some other amount. This process may be performed for each frequency band 504 of each sample block 601 of each audio channel 602.

As to interchannel redundancy, the control circuitry 302 of the device 300 may calculate a ratio of the energy of a band 504 of one of the adjacent interchannel blocks 604 (such as the kth block of audio channel A 602A) to the energy of the same band 504 of the other block of the adjacent interchannel blocks 604 (i.e., the kth block of audio channel B 602B). As with the temporal redundancy comparison, this ratio may then be compared to some predetermined value or percentage. If the ratio is less than the predetermined value, the scale factor for the band 504 of the first block 601 (i.e., the kth block of audio channel A 602A) may be increased by some amount, such as a value or percentage. Similarly, the reciprocal of this ratio, thus placing the energy of the same band 504 of the second block 601 (i.e., the kth block of audio channel B 602B) above that of the band 504 of the first block 601 (i.e., the kth block of audio channel A 602A) may be compared to the same predetermined value or percentage. If this ratio is less than the value or percentage, the scale factor for the band 504 in the second block 601 (i.e., the kth block of audio channel B 602B) may be increased in a similar manner to that described above. This process may be performed for each band 504 of each sample block 601 of each of the audio channels 602.

In some environment, more than two audio channels 602 are provided, such as in 5.1 and 7.1 stereo systems. Interchannel redundancy may be addressed in such systems so that each band 504 of each sample block 502 may be compared to its counterpart in more than one other audio channel 602. In other systems 400, certain audio channels 602 may be paired together based on their role in the audio scheme. For example, in 5.1 stereo audio, which includes a front center channel, two front side channels, two rear side channels, and a subwoofer channel, contemporaneous blocks 601 of the two front side channels may be compared against each other, as may the blocks 601 of the two rear side channels. In another example, blocks 601 of each of the front channels (left, right, and center channels) may be compared against each other to exploit any interchannel redundancies.

Figure 7:
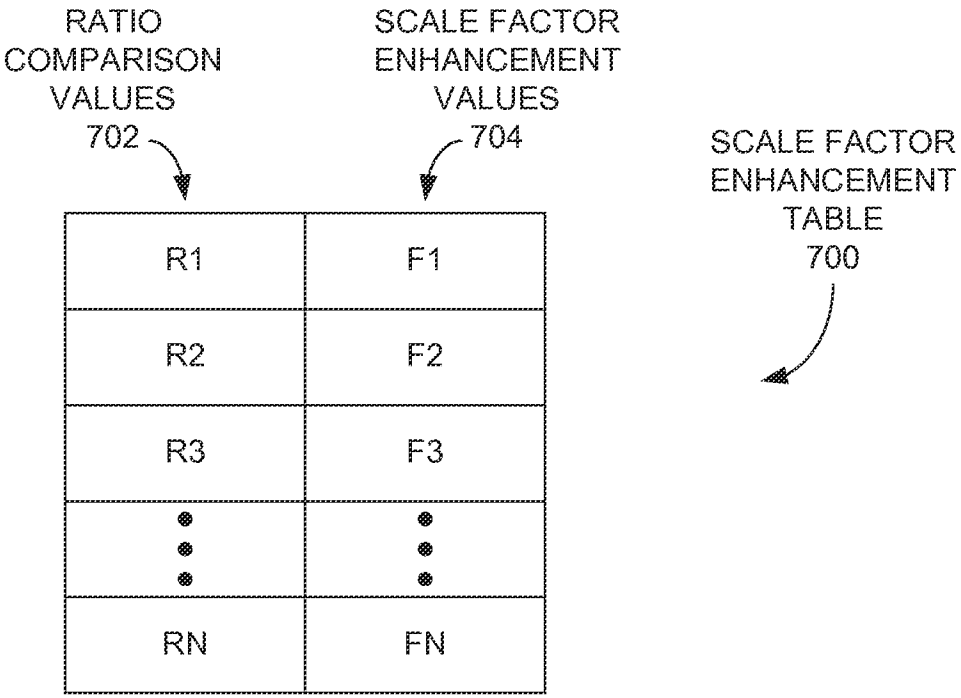
FIG. 7 is a scale factor enhancement table listing a number of ratios and associated enhancement values according to an embodiment of the invention.

In each of the examples discussed above, a ratio of energies related to a frequency band 604 is compared to a single predetermined value or percentage. In another implementation, the control circuitry 302 may compare each calculated ratio to more than one predetermined threshold. Depending on where the ratio lies among the comparison values, the associated scale factor may be adjusted by way of a different percentage or value. To this end, FIG. 7 provides one possible example of a scale factor enhancement table 700 containing several different ratio comparison values 702 against which the calculated ratios described above are to be compared. In the table 700, ratio R1 is greater than ratio R2, which is greater than ratio R3, and so on, continuing to ratio RN. Associated with each ratio 700 is an enhancement value 704, listed as F1, F2, F3, . . . FN, with F1 greater than F2, F2 greater than F3, and so forth. In operation, if a calculated ratio is greater than R1, the associated scale factor is not adjusted. If the ratio is less than R1, but greater than or equal to R2, the scale factor is increased by the enhancement value F1. Similarly, if the calculated ratio is less than R2, but at least as large as R3, the enhancement value F2 is applied. Continuing in this manner, ratios less than RN cause the scale factor to be adjusted or increased by enhancement value FN. Other methods of employing multiple predetermined ratio values 702 and corresponding scale factor enhancement values 704 may be employed in other embodiments.

Both the predetermined comparison values, such as the ratio comparison values 702, and the scale factor adjustments, such as the scale factor enhancement values 704 of the table 700, may be depend on a variety of system-specific factors. Therefore, for the best results in terms of bit-rate reduction of the encoded audio signal 320 without unduly compromising acceptable distortion levels for a particular application, the various comparison values and adjustment factors are best determined experimentally for that particular system 400.

While the scale factor adjustment function block 466 provides the above functionality of FIG. 4, other implementations may incorporate the functionality in other portions of the system 400. For example, either the perceptual model 450 or the scale factor generator 464 may receive both the MDCT information from the filter band 454 and the initial estimates of the scale factors from the scale factor generator 464 to perform the ratio calculation, value comparison, and scale factor adjustment discussed earlier.

A quantizer 468 following the scale factor adjustment function 466 in the pipeline employs the adjusted scale factor for each frequency band 504, as generated by the scale factor generator 466 (and possibly adjusted again by a rate/distortion control block 462, as described below), to divide the coefficients of the various frequencies 502 in that band 504. By dividing the coefficients, the coefficients are reduced or compressed in size, thus lowering the overall bit rate of the encoded audio signal 320. Such division results in the coefficients being quantized into one of some defined number of discrete values.

After quantization, a noiseless coding block 470 codes the resulting quantized coefficients according to a noiseless coding scheme. In one embodiment, the coding scheme may be the lossless Huffman coding scheme employed in AAC.

The rate/distortion control block 462, as depicted in FIG. 4, may readjust one or more of the scale factors being generated in the scale factor generator 466 and adjusted in the scale factor adjustment module 466 to meet predetermined bit rate and distortion level requirements for the encoded audio signal 320. For example, the rate/distortion control block 464 may determine that the calculated scale factor may result in an output bit rate for the encoded audio signal 320 that is significantly high compared to the average bit rate to be attained, and thus increase the scale factor accordingly.

After the scale factors and coefficients are encoded in the coding block 470, the resulting data are forwarded to a bitstream multiplexer 472, which outputs the encoded audio signal 320, which includes the coefficients and scale factors. This data may be further intermixed with other control information and metadata, such as textual data (including a title and associated information related to the encoded audio signal 320), and information regarding the particular encoding scheme being used so that a decoder receiving the audio signal 320 may decode the signal 320 accurately.

At least some embodiments as described herein provide a method of audio encoding in which the energy exhibited by audio frequencies within each frequency band of a sample block of an audio signal may be compared against the energy of an adjacent block to determine whether the block is carrying audio information that may be more coarsely quantized without significant loss of audio fidelity. Adjacent sample blocks may be consecutive blocks of a single audio channel, or blocks occurring at the same time in different audio channels. By comparing the energy of the frequencies in a particular frequency band in different blocks, the computational capacity required is minimal in comparison with typical AAC systems in which a masking threshold is calculated. Thus, use of the methods and devices cited herein may allow real-time audio encoding to be performed in more diverse environments with less expensive processing circuitry than would otherwise be possible.

While several embodiments of the invention have been discussed herein, other implementations encompassed by the scope of the invention are possible. For example, while at least one embodiment disclosed herein has been described within the context of a place-shifting device, other digital processing devices, such as general-purpose computing systems, television receivers or set-top boxes (including those associated with satellite, cable, and terrestrial television signal transmission), satellite and terrestrial audio receivers, gaming consoles, DVRs, and CD and DVD players, may benefit from application of the concepts explicated above. In addition, aspects of one embodiment disclosed herein may be combined with those of alternative embodiments to create further implementations of the present invention. Thus, while the present invention has been described in the context of specific embodiments, such descriptions are provided for illustration and not limitation. Accordingly, the proper scope of the present invention is delimited only by the following claims and their equivalents.

What is claimed is:

1. A method of encoding a time-domain audio signal, the method comprising:

at an electronic device, receiving the time-domain audio signal comprising at least one audio channel;

at an audio encoding system of the electronic device, transforming the time-domain audio signal into a frequency-domain signal comprising a sequence of sample blocks for each of the at least one audio channel, wherein each sample block comprises a coefficient for each of a plurality of frequency bands;

for each frequency band of each sample block, determining a scale factor for the frequency band;

at the audio encoding system of the electronic device, for each frequency band of each sample block, determining an energy of the frequency band;

at the audio encoding system of the electronic device, for each frequency band of each sample block, comparing the energy of the frequency band for the sample block with the energy of the frequency band of an adjacent sample block;

at a scale factor adjustment block of the audio encoding system of the electronic device for each frequency band of each sample block, adjusting the scale factor for the frequency band for the sample block if the energy of the frequency band of the sample block differs from the energy of the frequency band of the adjacent sample block by more than a predetermined amount; and at at least a bitstream multiplexer of the audio encoding system of the electronic device, generating an encoded audio signal using the adjusted scale factors.

2. The method of claim 1, wherein:

generating the encoded signal comprises encoding the quantized coefficients, wherein the encoded audio signal is based on the encoded coefficients and the scale factors.

3. The method of claim 1, wherein:

transforming the time-domain audio signal into the frequency-domain signal comprises performing a modified discrete cosine transform function on the time-domain audio signal.

4. The method of claim 1, wherein determining the energy of the frequency band comprises:

calculating an absolute sum of each of the coefficients of the frequency band of the sample block.

5. The method of claim 1, wherein:

the adjacent sample block of a first sample block comprises the sample block of the same audio channel as the first sample block that immediately precedes the first sample block in time.

6. The method of claim 5, wherein:

a time period represented by the adjacent sample block overlaps a time period represented by the first sample block.

7. The method of claim 1, wherein:

the adjacent sample block of a first sample block comprises a sample block of a different audio channel identified with the same time period associated with the first sample block.

8. The method of claim 7, further comprising:

for each frequency band of each sample block, comparing the energy of the frequency band for the sample block with the energy of the frequency band of a second adjacent sample block; and for each frequency band of each sample block, increasing the scale factor for the frequency band for the sample block if a ratio of the energy of the frequency band of the sample block to the energy of the frequency band of the second adjacent sample block is less than the predetermined value;

wherein the second adjacent sample block of a first sample block comprises a sample block of a second different audio channel identified with the same time period associated with the first sample block.

9. The method of claim 1, further comprising:

for each frequency band of each sample block, increasing the scale factor for the frequency band for the sample block if the ratio of the energy of the frequency band of the sample block to the energy of the frequency band of the adjacent sample block is less than a second predetermined value, wherein the second predetermined value is less than the first predetermined value, and wherein the increase in the scale factor involved with the second predetermined value is greater than the increase in the scale factor involved with the first predetermined value.

* * * * *